US011242688B2

(12) United States Patent
Bordin

(10) Patent No.: US 11,242,688 B2
(45) Date of Patent: Feb. 8, 2022

(54) DEVICE FOR LEVELING TILES

(71) Applicant: PROGRESS PROFILES SPA, Asolo (IT)

(72) Inventor: Dennis Bordin, Asolo (IT)

(73) Assignee: PROGRESS PROFILES SPA, Asolo (IT)

( * ) Notice: Subject to any disclaimer, the term of this patent is extended or adjusted under 35 U.S.C. 154(b) by 0 days.

(21) Appl. No.: 17/014,355

(22) Filed: Sep. 8, 2020

(65) Prior Publication Data

US 2021/0071432 A1 Mar. 11, 2021

(30) Foreign Application Priority Data

Sep. 9, 2019 (IT) ..... 102019000015848

(51) Int. Cl.
*E04F 21/20* (2006.01)

(52) U.S. Cl.
CPC ..... *E04F 21/20* (2013.01)

(58) Field of Classification Search
CPC ..... E04F 21/20; E04F 21/22; E04F 21/1877; E04F 15/02022; E04F 21/0092
See application file for complete search history.

(56) References Cited

U.S. PATENT DOCUMENTS 7,257,926 B1 * 8/2007 Kirby ..... E04F 21/0092 33/526
7,818,923 B2 10/2010 Alvarez
8,887,475 B2 11/2014 Ghelfi
9,534,403 B2 1/2017 Biec
2007/0214743 A1 9/2007 Alvarez
2014/0116001 A1 * 5/2014 Ghelfi ..... E04F 21/0092 52/749.11
2015/0308130 A1 * 10/2015 Biec ..... E04F 21/0092 52/749.11
2019/0169863 A1 * 6/2019 Torrents Comas ..... E04F 15/02022

(Continued)

FOREIGN PATENT DOCUMENTS

CN 203856178 U 10/2014
DE 202017101599 U1 4/2017
EP 2728088 A1 5/2014

(Continued)

OTHER PUBLICATIONS

IT Search Report dated Apr. 30, 2020 re: Application No. IT 2019000015848, pp. 1-8, citing: WO 2014/195780 A1, EP 3 492 671 A1, WO 2019/111150 A1, US 9 534 403 B2, CN 203 856 178 U, US 7 818 923 B2.

(Continued)

*Primary Examiner* — Patrick J Maestri
(74) *Attorney, Agent, or Firm* — Cantor Colburn LLP

(57) ABSTRACT

A device for levelling tiles includes a traction member having a base which can be inserted below two or more of the tiles which are adjacent at mutual edges, and a C-shaped element extending from the base, the free ends of its wings being associated with the base. The device further includes a wedge having a surface with a serrated profile for interaction with the traction member at an edge of the core of the C-shaped element. The wedge is insertable inside the C-shaped element of the traction member between the wings thereof.

7 Claims, 3 Drawing Sheets

(56) References Cited

U.S. PATENT DOCUMENTS

2019/0338536 A1* 11/2019 Bordin ..... E04F 15/02022

FOREIGN PATENT DOCUMENTS

| | | | |
|---|---|---|---|
| EP | 3492671 | A1 | 6/2019 |
| JP | 3203020 | U | 3/2016 |
| WO | 2014195780 | A1 | 12/2014 |
| WO | 2019111150 | A1 | 6/2019 |

OTHER PUBLICATIONS

Extended European Search Report dated Jan. 27, 2021 re: Application No. EP 20 19 3926, pp. 1-8, citing: WO 2014/195780 A1, EP 3 492 671 A1, WO 2019/111150 A1, US 9 534 403 B2, EP 2 728 088 A1, CN 203 856 178 U and US 7 818 923 B2.

9plitok.ru "Wedge TLS-profi", SVP Systems for Tiles: 3D crosses, tLS, DLS, SVP NOVA, Wedge TLS-profi, Mar. 16, 2021, pp. 1-6.

* cited by examiner

DEVICE FOR LEVELING TILES

CROSS REFERENCE TO RELATED APPLICATIONS

This application is related to and claims the benefit of Italian Patent Application No. 102019000015848, filed on Sep. 9, 2019, the contents of which are herein incorporated by reference in their entirety.

TECHNICAL FIELD

The present disclosure relates to a device for leveling tiles, during the step of laying.

BACKGROUND

Nowadays, when laying tiles, devices are used to level them and obtain a uniformly leveled (tiled) surface.

Usually, two types of device are used for leveling tiles.

A first type of device comprises a handgrip which is screwed onto a threaded stem, extending from a supporting base which is to be inserted below two or more tiles which are adjacent at mutual edges.

A second type of device comprises:

a wedge with a surface with a serrated profile for interaction with a traction member, a traction member constituted by a base which is to be inserted below two or more tiles which are adjacent at mutual edges, from which a C-shaped element extends, with the free ends of the wings associated with the base.

The wedge is inserted into the C-shaped element, between its wings, with a surface thereof in contact with the surface of the tiles, to which the traction member is applied, that lies opposite to the surface directed toward the base of the traction member.

In particular, the serrated surface of the wedge interacts with the core of the C-shaped element of the traction member.

This C-shaped element is arranged at a gap between two or more tiles.

The surface of the wedge that is in contact with the core of the C-shaped element is inclined with respect to the surface of the wedge that is in contact with the tiles.

In this manner it is possible to easily insert the wedge into the C-shaped element and, by virtue of its variable height, given by the distance between its surfaces illustrated above, level the tiles.

The core of the C-shaped element has a thinned edge for interacting with the serrated surface of the wedge.

In particular, the thickness of this edge is less than the distance between two consecutive teeth of the serrated surface.

Thus as the wedge advances through the C-shaped element, the thinned edge clicks from one valley, between two consecutive teeth, to the next one, without the risk that it could retreat, and ease up the tension on the tiles.

Such conventional techniques have a number of drawbacks.

As mentioned, the wedge has a serrated surface which is inclined with respect to a surface directed toward the tiles, and between these two surfaces there are:

two lateral surfaces having a substantially triangular profile, a rear surface, substantially flat, comprised between the two lateral surfaces.

A flat tightening portion of a special clamp interacts with this rear surface.

It is therefore always necessary to use a tool to position the wedge.

If the tiler does not have the clamp conveniently available, then he or she will have difficulty with positioning the wedge using only his or her hands, since the rear surface cannot be handled easily.

Also, the base of the traction member is generally flat and is constituted by continuous portions, joined together to produce a discontinuous external perimetric edge.

The expression "continuous portions" in the present description means portions that do not have holes and/or openings that pass through the thickness.

The expression "discontinuous external perimetric edge", in the present description, means that the external perimetric edge has recesses and/or points of discontinuity.

This can result in an adhesive bonding of the base that is not always optimal, with the risk that it could shift during the laying and leveling of the tiles.

Furthermore, according to the desired width of the gaps, the wings of the C-shaped element have a different thickness.

The measurement of the thickness is written on the wings, but this results in the drawback, for the tiler, of having to read the value stamped on it in order to understand the thickness of the C-shaped element and select the right traction members, and this operation is not always easy.

SUMMARY

The aim of the present disclosure is to provide a device for leveling tiles that is capable of improving the known art in one or more of the above mentioned aspects.

Within this aim, the disclosure provides a device for leveling tiles that enables a more effective adhesive bonding of the base of the traction member with respect to similar conventional devices.

The disclosure also provides a device for leveling tiles that does not entail the use of special tools.

The disclosure further provides a device for leveling tiles that bears an indication of the thickness of the wings of the traction member that is more immediate than similar conventional devices, in order to enable the tiler to more easily and rapidly provide the gap of the desired width.

The present disclosure overcomes the drawbacks of the known art in an alternative manner to any existing solutions.

The disclosure provides a device for leveling tiles that is highly reliable, easy to implement and of low cost.

This aim and these and other advantages which will become better apparent hereinafter are achieved by providing a device for leveling tiles that comprises:

a traction member comprising a base which can be inserted below two or more of said tiles which are adjacent at mutual edges, a C-shaped element extending from said base, free ends of its wings being associated with said base, and a wedge having a surface with a serrated profile for interaction with said traction member at an edge of the core of said C-shaped element, said wedge being insertable inside said C-shaped element of said traction member between said wings thereof, said device being characterized in that said base of said traction member has a continuous external perimetric edge and one or more openings which pass through its thickness.

BRIEF DESCRIPTION OF THE DRAWINGS

Further characteristics and advantages of the disclosure will become better apparent from the detailed description that follows of a preferred, but not exclusive, embodiment of the device for leveling tiles according to the disclosure, which is illustrated for the purposes of non-limiting example in the accompanying drawings wherein.

DETAILED DESCRIPTION OF THE DRAWINGS

Figure 1A:
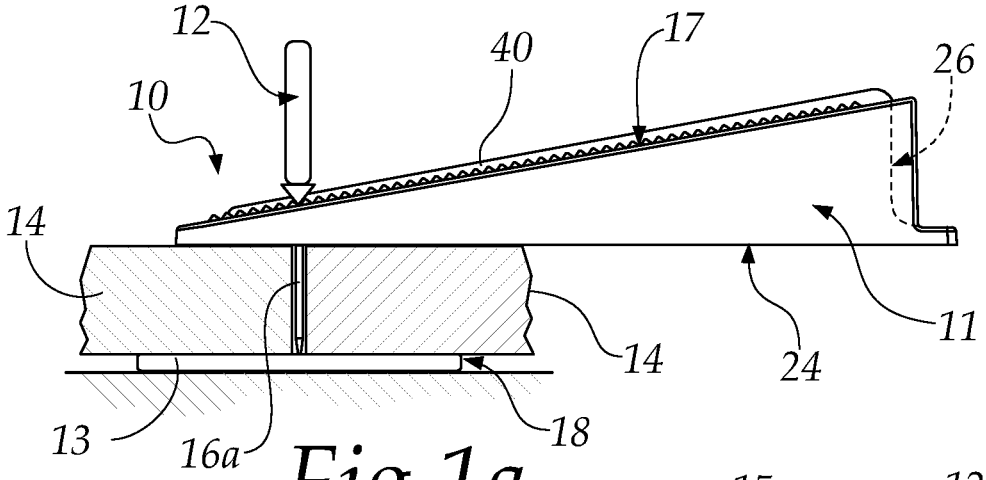
FIG. 1*a* and 1*b* are two cross-sectional views of a device for leveling tiles, according to the disclosure, in two different applications.
Figure 1B:
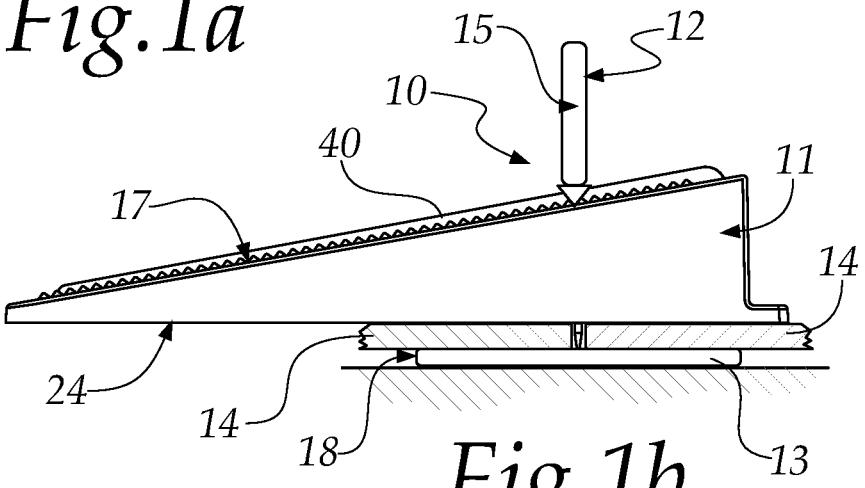
Figure 2:
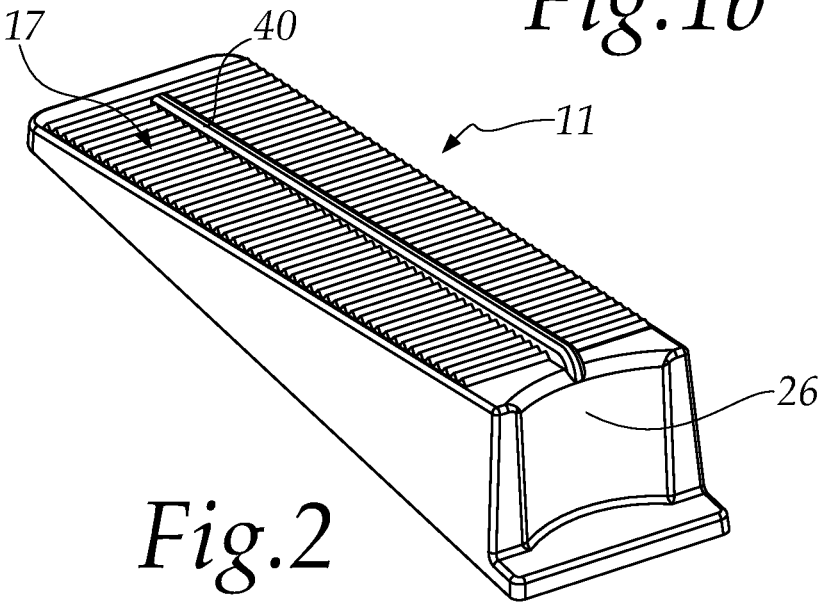
FIG. 2 is a perspective view of a first element of the device of FIGS. 1*a* and 1*b;*
Figure 2A:
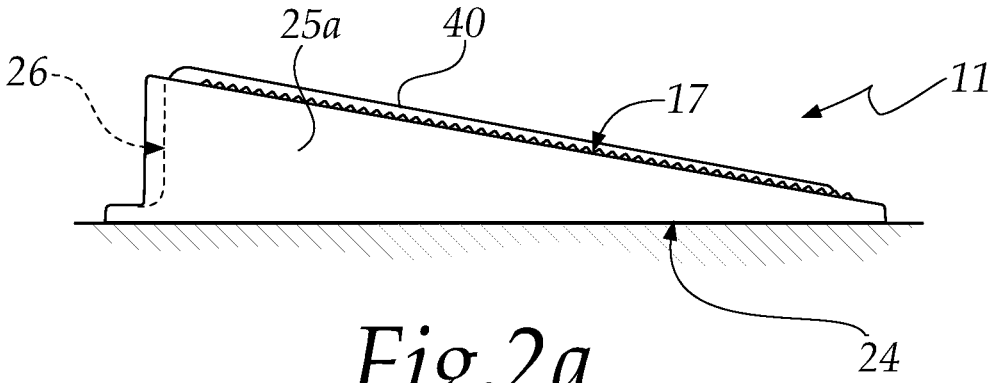
FIGS. 2*a* and 2*b* are two different views of the element of FIG. 2.
Figure 2B:
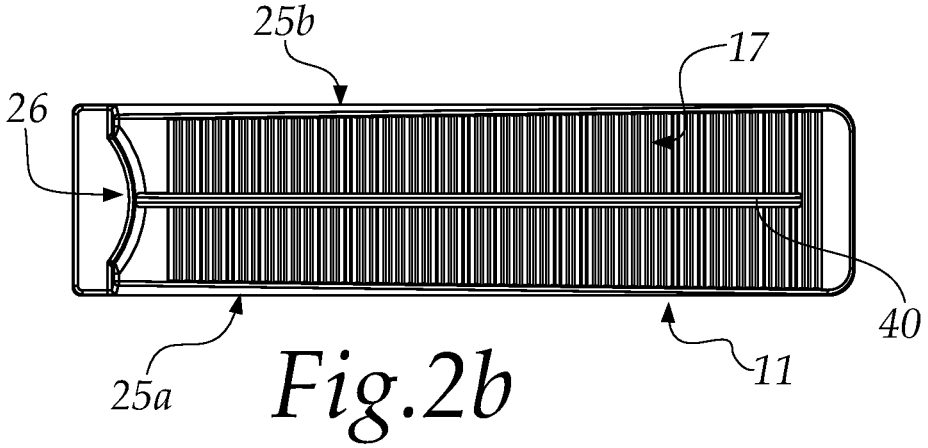

With reference to the figures, a device for leveling tiles, according to the disclosure, is generally designated by the reference numeral 10.

The device 10 comprises a wedge 11 and a traction member 12.

The wedge 11 is made of plastic material such as, for example, polyethylene, polypropylene, polycarbonate or the like.

Such wedge 11 is a presser.

The traction member 12 is made of plastic material such as, for example, polyethylene, polypropylene, polycarbonate or the like.

The traction member 12 comprises a base 13 which is to be inserted below two or more tiles 14 which are adjacent at mutual edges.

a C-shaped element 15 extends from such base 13, with the free ends of its wings 16*a*, 16*b* being associated with the base 13.

The wedge 11 has a surface 17 with a serrated profile for interaction with the traction member 12, at the edge 20 of the core 21 of the C-shaped element 15 that is directed toward the base 13, and which is thinned.

Such wedge 11 is provided with a partition 40 which extends from the surface 17 with a serrated profile, at right angles thereto.

The partition 40 has a longitudinal extension, in the same direction of extension as the wedge 11, at its sagittal plane of symmetry.

The expression "sagittal plane of symmetry", in the present description, means that the plane of symmetry runs in the fore-and-aft direction and divides a body into two parts, right and left, that are symmetrical with it.

Such partition 40 is adapted to facilitate the alignment with the traction member 12.

The wedge is inserted, in the configuration for use, into the C-shaped element 15 of the traction member 12 between its wings 16*a* and 16*b*.

Figure 3:
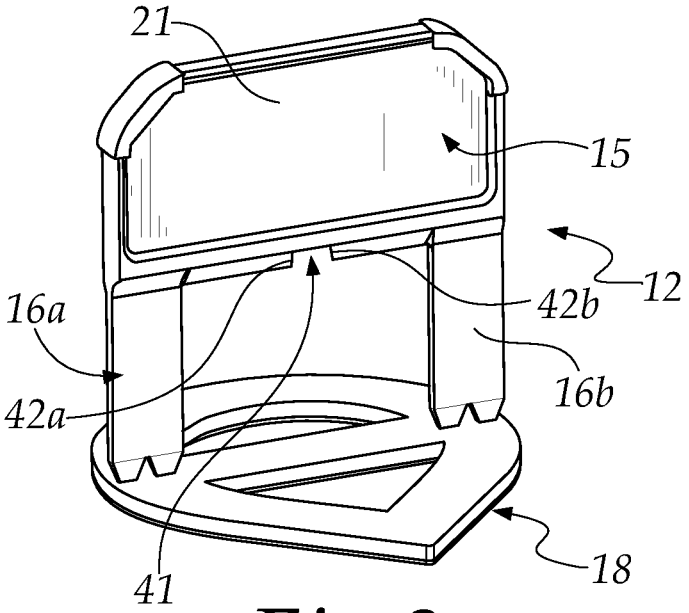
FIG. 3 is a perspective view of a second element of the device of FIGS. 1*a* and 1*b*.
Figure 3A:
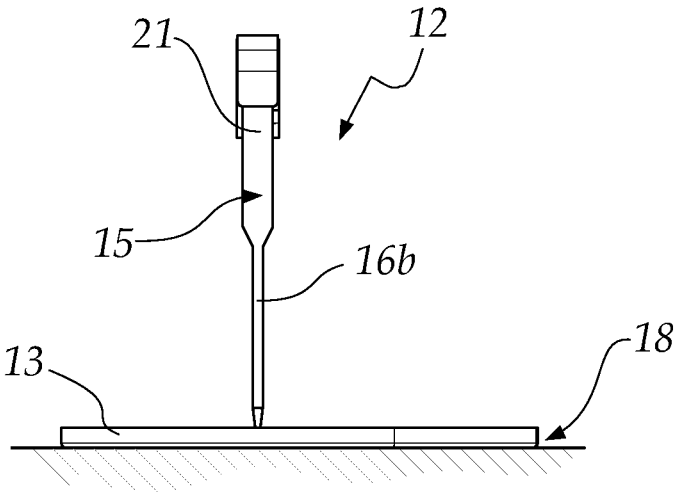
FIGS. 3*a* to 3*c* are three different views of the element of FIG. 3.
Figure 3B:
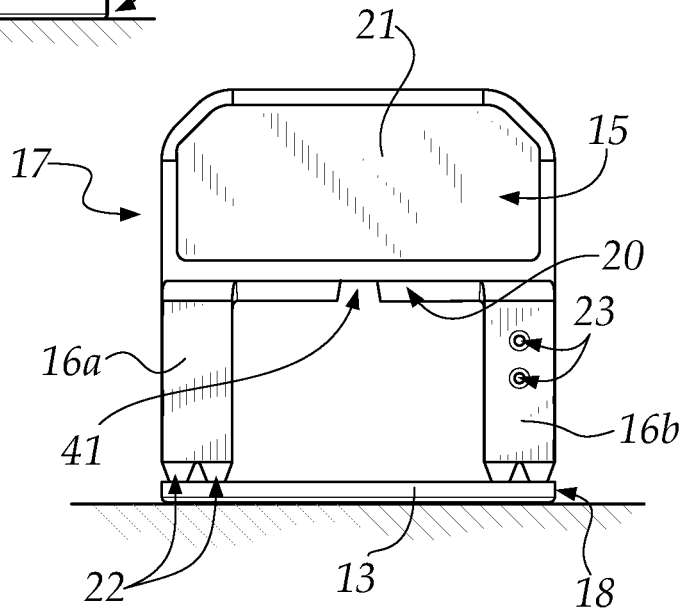
Figure 3C:
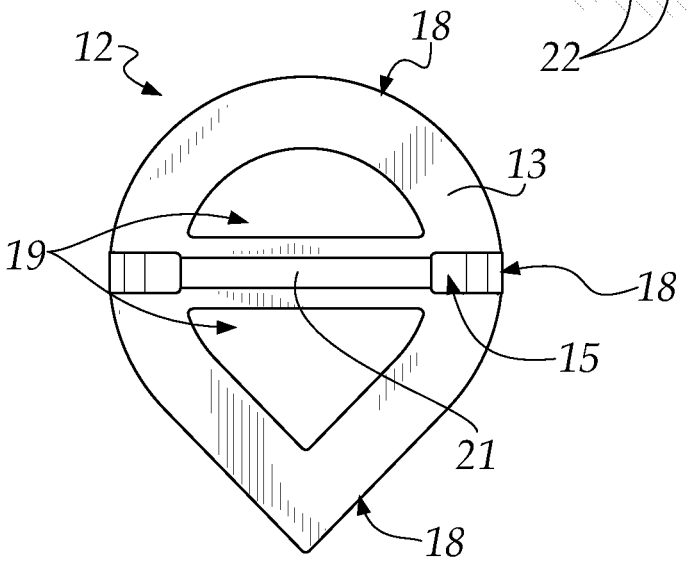

One of the peculiarities of the device is that the base 13 of the traction member 12 has a continuous external perimetric edge 18 and one or more openings 19 which pass through its thickness, as can be seen in FIG. 3*c*.

The expression "continuous external perimetric edge", in the present description, means that the external perimetric edge does not have recesses and/or points of discontinuity.

In this manner, the adhesive covers the base 13, penetrates into its openings 19 and results in a better anchoring than similar conventional traction members.

In the example shown in the figures, the base 13 has a teardrop-shaped profile. However, in variations of embodiment, not shown, the base 13 can have a different profile such as, for example, quadrangular, circular or triangular.

The wings 16*a*, 16*b* are associated, at their free end, with the base 13.

Each one of the wings 16*a*, 16*b* has a region amenable to breakage, at the base 13, which is constituted by two points 22 for joining to the base 13 which are separate, spaced apart and easily breakable.

The expression "easily breakable", in the present description, means that the joining points 22 can be broken by delivering a kick to the part of the C-shaped element that protrudes from the gaps of the tiles, after they have been laid.

There are thickness indicators on at least one of the two wings 16*a*, 16*b*.

These thickness indicators can be one or more holes 23 which pass through the thickness.

These through holes 23 are adapted to immediately and unambiguously indicate the thickness of the wings 16*a*, 16*b*, and therefore the thickness of the gaps that can be obtained with the particular traction member 12 selected.

For example, considering FIG. 3*b*, the maker of traction members can define that each hole 23 represents the thickness of 1 mm. In such case, the traction member 12 shown in FIG. 3*b* is adapted to provide gaps of 2 mm.

In other embodiments, not shown in the figures, the through holes 23 indicating the thickness are placed elsewhere, for example on the core 21 of the C-shaped element 15 or on the base 13.

In other embodiments, not shown in the figures, the holes 23 are dead.

In further embodiments, not shown in the figures, the thickness indicators are constituted by notches.

The edge 20 of the core 21 of the C-shaped element 15 is thinned with respect to the thickness of the core 21.

In particular, the thickness of the edge 20 is less than the distance between two consecutive teeth of the surface 17 with a serrated profile of the wedge 11.

Thus, during use, as the wedge 11 advances through the C-shaped element 15, the edge 20 of its core 21 clicks from one valley, between two consecutive teeth, to the next one, without the risk that it could retreat, and ease up the tension on the tiles 14.

The edge 20 of the core 21 has a recess 41 into which the partition 40 is inserted for mutual alignment between the traction member 12 and the wedge 11.

The opposite edges of the recess 41, respectively 42*a* and 42*b*, have divergent progression.

In this manner, the partition 40 is easily inserted into the recess 41 and can be brought close to one edge or the other if needed.

The surface 17 with a serrated profile of the wedge 11 is inclined with respect to a surface 24 that is directed toward the tiles 14 and in contact with them, during use.

Between the surface 17 with a serrated profile and the surface 24 directed toward the tiles 14 of the wedge 11, there are:

two lateral surfaces 25*a* and 25*b*, having a substantially triangular profile, a rear surface 26, comprised between the two lateral surfaces 25*a* and 25*b*.

One of the peculiarities of the disclosure is that the rear surface 26 is concave.

In this manner, the wedge 11 can be handled easily even without using special tools, by pushing the wedge 11 into the C-shaped element 15, by imparting a force with the fingers on the rear surface 26.

In practice it has been found that the disclosure fully achieves the intended aim and advantages by providing a device for leveling tiles that enables a more effective adhesive bonding of the base of the traction member with respect to similar conventional devices.

With the disclosure a device is provided for leveling tiles that can be easily used without the use of special tools.

Finally, with the disclosure a device is provided for leveling tiles that bears an indication of the thickness of the wings of the traction member that is more immediate than similar conventional devices, in order to enable the tiler to more easily and rapidly provide the gap of the desired width.

The disclosure thus conceived is susceptible of numerous modifications and variations, all of which are within the scope of the appended claims Moreover, all the details may be substituted by other, technically equivalent elements.

In practice the materials employed, provided they are compatible with the specific use, and the contingent dimensions and shapes, may be any according to requirements and to the state of the art.

The disclosures in Italian Patent Application No. 102019000015848 from which this application claims priority are incorporated herein by reference.

The base of the traction member has a continuous external perimetric edge and one or more openings which pass through its thickness.

What is claimed is:

1. A device for levelling tiles, the device comprises:

a traction member including a base configured to be inserted below two or more of tiles to be levelled which are adjacent at mutual edges, and a C-shaped element extending from said base and having at least two wings, free ends of said wings being attached to said base, a wedge having a surface with a serrated profile for interaction with said traction member at an edge of a core of said C-shaped element, said wedge being insertable inside said C-shaped element of said traction member between said wings, wherein said base of said traction member has a teardrop-shaped profile and a continuous external perimetric edge and one or more openings which pass through a thickness, wherein said one or more openings are configured to be penetrated by an adhesive covering said base, wherein said wedge is provided with a partition which extends from said surface with a serrated profile, at right angles thereto, and said edge of said core has a recess into which said partition can be inserted, wherein each one of said wings of said traction member has a region amenable to breakage, at said base, which is constituted by two points for joining to said base which are separate, spaced apart and easily breakable.

2. The device according to claim 1, wherein at least one thickness indicator is disposed on at least one of said wings.

3. The device according to claim 1, wherein said edge of said core of said C-shaped element is thinner than said core, said edge of said core having a thickness that is less than a distance between two consecutive teeth of said surface with a serrated profile of said wedge.

4. The device according to claim 1, wherein said surface with a serrated profile of said wedge is inclined with respect to a surface that is to be directed toward said tiles to be levelled and in contact with said tiles to be levelled, during use.

5. The device according to claim 4, wherein, between said surface with a serrated profile and said surface that is to be directed toward said tiles to be levelled of said wedge, there are:

two lateral surfaces having a substantially triangular profile, and a rear surface comprised between said lateral surfaces.

6. The device according to claim 5, wherein said rear surface is concave.

7. The device according to claim 1, wherein said traction member and said wedge are made of plastic material.

* * * * *